US012252983B2

(12) United States Patent
Romer et al.

(10) Patent No.: US 12,252,983 B2
(45) **Date of Patent: *Mar. 18, 2025**

(54) PLUNGER LIFT SYSTEMS AND RELATED METHODS

(71) Applicant: EXXONMOBIL TECHNOLOGY AND ENGINEERING COMPANY, Spring, TX (US)

(72) Inventors: Michael C. Romer, Tomball, TX (US); Michael C. Tschauner, Odessa, TX (US); Christopher C. Frazier, Midland, TX (US); Andrew D. McFadden, Midland, TX (US); Salvador G. Vela, III, Odessa, TX (US); Billy-Bob K. Walker, Midland, TX (US); Adam J. Johnson, Midland, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/594,702

(22) Filed: Mar. 4, 2024

(65) Prior Publication Data

US 2024/0200442 A1 Jun. 20, 2024

Related U.S. Application Data

(63) Continuation of application No. 17/658,856, filed on Apr. 12, 2022, now Pat. No. 11,952,887.

(Continued)

(51) Int. Cl.

*E21B 47/12* (2012.01)
*E21B 43/12* (2006.01)

(Continued)

(52) U.S. Cl.

CPC ..... *E21B 47/12* (2013.01); *E21B 43/122* (2013.01); *E21B 47/008* (2020.05); *E21B 47/092* (2020.05)

(58) Field of Classification Search

CPC .... E21B 43/122; E21B 43/123; E21B 43/129; E21B 47/008; E21B 47/092; E21B 47/12

See application file for complete search history.

(56) References Cited

U.S. PATENT DOCUMENTS 2,845,940 A * 8/1958 Garrett ..... E21B 43/123 251/145
2,954,043 A * 9/1960 Canalizo ..... E21B 43/123 137/853

(Continued)

FOREIGN PATENT DOCUMENTS

WO WO-2015101859 A1 * 7/2015 ..... E21B 43/121

*Primary Examiner* — Jennifer H Gay

(74) *Attorney, Agent, or Firm* — ExxonMobil Technology and Engineering Company—Law Department

(57) ABSTRACT

A plunger lift system, as well as a method for monitoring plunger parameters within a wellbore using such a plunger lift system, are provided. The plunger lift system includes a lubricator attached to a wellhead at the surface and a plunger dimensioned to travel through the production tubing upon being released from the lubricator. The plunger lift system also includes magnetic sensor systems installed along the production tubing, where each magnetic sensor system includes a magnetic sensor for detecting the passage of the plunger as it travels through the production tubing, as well a communication device for transmitting communication signals between the magnetic sensor systems and a computing system located at the surface, where the computing system includes a processor and a non-transitory, computer-readable storage medium including computer-executable instructions that direct the processor to dynamically deter- (Continued)

mine the plunger position and/or velocity based on the received communication signals.

20 Claims, 7 Drawing Sheets

Related U.S. Application Data

(60) Provisional application No. 63/203,264, filed on Jul. 15, 2021.

(51) Int. Cl.
*E21B 47/008* (2012.01)
*E21B 47/092* (2012.01)

(56) References Cited

U.S. PATENT DOCUMENTS 3,095,819 A * 7/1963 Brown ..... F04B 47/12 251/65
4,211,279 A * 7/1980 Isaacks ..... E21B 43/122 166/70
5,458,200 A * 10/1995 Lagerlef ..... E21B 43/123 166/372
5,706,892 A * 1/1998 Aeschbacher, Jr. ... E21B 49/087 166/69
5,839,508 A * 11/1998 Tubel ..... G01V 1/42 166/66.5
5,896,924 A * 4/1999 Carmody ..... E21B 34/066 166/69
6,467,541 B1 * 10/2002 Wells ..... F04B 47/12 166/372
10,273,801 B2 * 4/2019 Shah ..... E21B 43/123
10,697,287 B2 * 6/2020 Romer ..... E21B 47/06
10,830,003 B2 * 11/2020 Romer ..... F04B 47/12
11,162,351 B2 * 11/2021 Mericas ..... E21B 47/092
11,319,785 B1 * 5/2022 Green ..... E21B 43/122
11,448,049 B2 * 9/2022 Boyd ..... E21B 43/128
11,555,387 B2 * 1/2023 Green ..... E21B 43/13
11,585,193 B1 * 2/2023 Hunt ..... E21B 43/123
11,952,887 B2 * 4/2024 Romer ..... F04B 49/065
2002/0043369 A1 * 4/2002 Vinegar ..... H04B 13/02 166/250.07
2003/0164240 A1 * 9/2003 Vinegar ..... E21B 41/0085 137/155
2008/0030365 A1 * 2/2008 Fripp ..... E21B 47/16 340/853.1
2012/0193091 A1 * 8/2012 Bender ..... E21B 47/008 166/250.15
2013/0220599 A1 * 8/2013 Rae ..... E21B 34/105 166/250.01
2014/0231079 A1 * 8/2014 Scantlebury ..... E21B 47/00 166/113
2015/0000761 A1 * 1/2015 Jefferies ..... E21B 43/121 137/554
2015/0136389 A1 * 5/2015 Bergman ..... F04B 47/12 166/250.15
2015/0377009 A1 * 12/2015 Frosell ..... E21B 23/01 166/382
2016/0076363 A1 * 3/2016 Morrow ..... E21B 43/11 166/381
2016/0160632 A1 * 6/2016 Mericas ..... E21B 47/092 73/152.01
2017/0175503 A1 * 6/2017 Scantlebury ..... F04B 49/22
2017/0211364 A1 * 7/2017 Scantlebury ..... G05B 15/02
2018/0058191 A1 * 3/2018 Romer ..... E21B 49/08
2018/0119692 A1 * 5/2018 Bangor ..... E21B 47/107
2018/0340413 A1 * 11/2018 Shah ..... E21B 47/18
2020/0032592 A1 * 1/2020 Romer ..... E21B 43/121
2021/0071505 A1 * 3/2021 Boyd ..... G01F 1/38
2021/0095547 A1 * 4/2021 Grueschow ..... E21B 43/123
2021/0172300 A1 * 6/2021 Rodger ..... E21B 34/066
2022/0259955 A1 * 8/2022 Green ..... E21B 43/12
2022/0372852 A1 * 11/2022 Schmidt ..... E21B 43/121
2023/0019787 A1 * 1/2023 Romer ..... E21B 47/092
2024/0200442 A1 * 6/2024 Romer ..... F04B 49/065

* cited by examiner

PLUNGER LIFT SYSTEMS AND RELATED METHODS

CROSS-REFERENCE TO RELATED APPLICATIONS

This application is a Continuation of U.S. patent application Ser. No. 17/658,856, filed Apr. 12, 2022, which claims the benefit of U.S. Provisional Application Ser. No. 63/203,264, filed Jul. 15, 2021, the disclosure of which is hereby incorporated reference in its entirety.

FIELD OF THE INVENTION

The techniques described herein relate generally to artificial lift techniques within the hydrocarbon production field. More specifically, the techniques described herein relate to systems and methods for improving plunger lift techniques through the determination of plunger parameters using magnetic sensors.

BACKGROUND OF THE INVENTION

This section is intended to introduce various aspects of the art, which may be associated with embodiments of the present techniques. This discussion is believed to assist in providing a framework to facilitate a better understanding of particular aspects of the present techniques. Accordingly, it should be understood that this section should be read in this light, and not necessarily as admissions of prior art.

During the drilling of a well, large diameter wellbores are cased, leading to narrow diameter wellbores which are also cased, finally leading to the production zone in the reservoir. As each section is cased, concrete is injected around the casing to hold it in place. The well is then completed by operations to begin the production of hydrocarbon fluids from the reservoir. Production tubing is then inserted down the wellbore into the production zone.

After completion, many hydrocarbon wells initially have sufficient reservoir pressure to force hydrocarbon fluids from the reservoir to the surface. However, as production continues, the reservoir pressure gradually declines, causing the velocity of the hydrocarbon fluids in the production tubing to gradually decrease until the production rate falls below an acceptable level. At this point, artificial lift techniques may be utilized to facilitate and/or increase the production rate. Artificial lift techniques include a variety of systems and methods for aiding in the transportation of hydrocarbon fluids from the reservoir to the surface when the reservoir pressure alone is not sufficient.

Gas lift is a commonly-utilized form of artificial lift that is particularly well-suited for high-volume, offshore wells. During gas lift operations, a high-pressure gas (e.g., typically methane, ethane, nitrogen, and/or other related produced gas combinations) is injected into the production tubing via the casing annulus. The high-pressure gas then travels to a number of gas lift valves (GLVs), which are typically stacked vertically along the production tubing within the annulus. The GLVs provide a pathway for a designed volume of injected gas to enter the production tubing. This decreases the density of the fluid column, thereby reducing the hydrostatic head and decreasing the backpressure on the production zones in the reservoir. The available reservoir pressure can then force more hydrocarbon fluids to the surface. In operation, GLVs are effectively pressure regulators and are typically installed during well completion. In many cases, a number of "unloading valves" are used to remove completion fluid from the annulus so that the injected gas can reach the final "operating valve." Once the injected gas reaches the operating valve, the operating valve is ideally the only GLV left open. Gas entering the operating valve may then assist in the production of hydrocarbon fluids from the reservoir.

Plunger lift is another commonly-utilized form of artificial lift that is typically used to deliquefy gas-dominated, onshore wells. In particular, plunger lift is used to periodically unload relatively small volumes of fluid (e.g., typically liquid with any associated sands) from the production tubing by carrying such fluid to the surface. During plunger operations, a small metal cylinder (referred to as a "plunger") travels vertically along the production tubing within the wellbore. The plunger is similar in form and function to a pipeline pig and is designed to force the hydrostatic head up the wellbore and to the surface in response to a build-up of reservoir pressure. In operation, the plunger travels between the wellhead and a downhole bumper spring in a cyclic fashion. As the plunger travels through the wellbore, it provides a barrier that inhibits gas breakthrough and effectively carries a liquid slug to the surface. The differential pressure created by this action assists the well in lifting liquids to the surface with lower gas velocities than those normally reached. This mitigates the cost of installing production tubing with a smaller inner diameter (ID) to increase the gas velocity.

In a conventional plunger lift system, a wellhead including a specialized extension referred to as a "lubricator" is provided at the surface. The lubricator typically includes an energy-absorbing spring and a catch. In normal operation, the plunger rests in the lubricator (or in a pup joint) at the surface above the wellhead valves. When suitable plunger lift conditions are detected (e.g., via surface measurements and gauges), the well is typically shut in, and the lubricator drops the plunger into the wellbore. After a sufficient measured (or estimated) time, the well is brought back onto production, causing the plunger to travel back to the surface along with the accumulated hydrocarbon fluids (e.g., primarily liquids) that have slowed or stopped production due to their associated hydrostatic weight. Moreover, as the plunger approaches the surface, the spring within the lubricator absorbs the mechanical impact of the plunger, while the catch maintains the plunger within the lubricator to allow the hydrocarbon fluids to flow more freely from the well. In this manner, the plunger is prepared to be used again when suitable plunger lift conditions are detected.

As the hydrocarbon well continues to age, it is common that the cycle for dropping the plunger becomes longer and longer due to the continued decline of the reservoir pressure. Eventually, shut-ins of several days or weeks may be required to build up enough pressure to return the plunger to the surface. At this point, the well operator typically considers additional and/or alternative artificial lift techniques to enable economic production volumes.

A relatively recent approach has been to combine plunger lift with gas lift. This artificial lift technique is sometimes referred to as "gas-assisted plunger lift," or "GAPL." (Alternatively, it is sometimes referred to as "plunger-assisted gas lift," or "PAGL.") With GAPL, the injected lift gas typically creates enough gas velocity and pressure (along with the reservoir pressure below the plunger) to assist the plunger and the accumulated hydrocarbon fluids in traveling up to the surface. Currently, it is typical for GAPL to be implemented in a packerless, "poor-boy" design, in which the lift gas is forced down the annulus and all the way to the bottom of the well, where it enters around the end of the production tubing and then travels back up to the surface. However, the poor-boy GAPL design is notably inefficient since there is little control over the injected gas rates at the lift point. Furthermore, the injection of the gas at the bottom of the well may create a potentially-undesirable build-up of well pressure. As a result, GAPL is sometimes implemented by installing conventional mandrels on the production tubing (or utilizing already-installed conventional mandrels for wells that have previously benefited from gas lift techniques). In particular, the conventional mandrels may be welded to the outer diameters of the production tubing with integral gas lift valves such that the ID of the production tubing is not altered. Standard gas lift principles may then be used to assist with returning the plunger to the surface. Importantly, the plunger can operate as designed in both the poor-boy and conventional-mandrel configurations since there are no changes to the internal dimensions of the production tubing.

As will be appreciated by those skilled in the art, both conventional plunger lift systems and GAPL systems could benefit from the determination of various parameters relating to plunger operation. However, conventional techniques for determining such parameters are generally inefficient and/or inaccurate. Accordingly, there exists a need for improved techniques for determining plunger parameters with respect to both conventional plunger lift systems and GAPL systems.

SUMMARY OF THE INVENTION

An embodiment described herein provides a plunger lift system for monitoring plunger parameters within a wellbore. The wellbore includes a production tubing for conveying fluids from a reservoir to the surface. The plunger lift system includes a lubricator attached to a wellhead at the surface, a plunger dimensioned to travel through the production tubing upon being released from the lubricator, and a bumper spring residing in the production tubing and configured to receive the plunger when the plunger travels toward the bottom of the wellbore. The plunger lift system also includes magnetic sensor systems installed along the production tubing, where each magnetic sensor system includes a magnetic sensor for detecting the passage of the plunger as it travels through the production tubing, as well as a communication device that is configured to transmit communication signals between each magnetic sensor system and a computing system located at the surface. The plunger lift system further includes the computing system, where the computing system includes a processor and a non-transitory, computer-readable storage medium including computer-executable instructions that direct the processor to dynamically determine the plunger position and/or the plunger velocity based on the communication signals received from the magnetic sensor systems. For embodiments in which the plunger lift system is a gas-assisted plunger lift system, the plunger lift system also includes an injection line for injecting lift gas down the annulus of the wellbore and back up the production tubing to the surface to assist with the return of the plunger to the lubricator at the surface. In such embodiments, the plunger lift system may optionally include mandrels for securing gas lift valves to the production tubing, and the magnetic sensor systems may optionally be installed within (or attached to) such mandrels.

Another embodiment described herein provides a method for monitoring plunger parameters within a wellbore corresponding to a plunger-lifted well, where the wellbore includes a production tubing with magnetic sensor systems disposed along the production tubing. The method includes sensing, via a magnetic sensor within each magnetic sensor system, a passage of a metallic plunger traveling through the production tubing, as well as transmitting resulting electrical sensor signals to a computing system located at the surface, where the electrical sensor signals include data relating to a time at which the metallic plunger passed each magnetic sensor system. The method may further include dynamically determining the plunger position and/or plunger velocity based on the electrical sensor signals, as well as controlling plunger performance (and, for embodiments in which the plunger lift system is a gas-assisted plunger lift system, gas lift performance) in response to the determination of the plunger position and/or plunger velocity.

These and other features and attributes of the disclosed embodiments of the present disclosure and their advantageous applications and/or uses will be apparent from the detailed description which follows.

BRIEF DESCRIPTION OF THE DRAWINGS

To assist those of ordinary skill in the relevant art in making and using the subject matter thereof, reference is made to the appended drawings.

Figure 1:
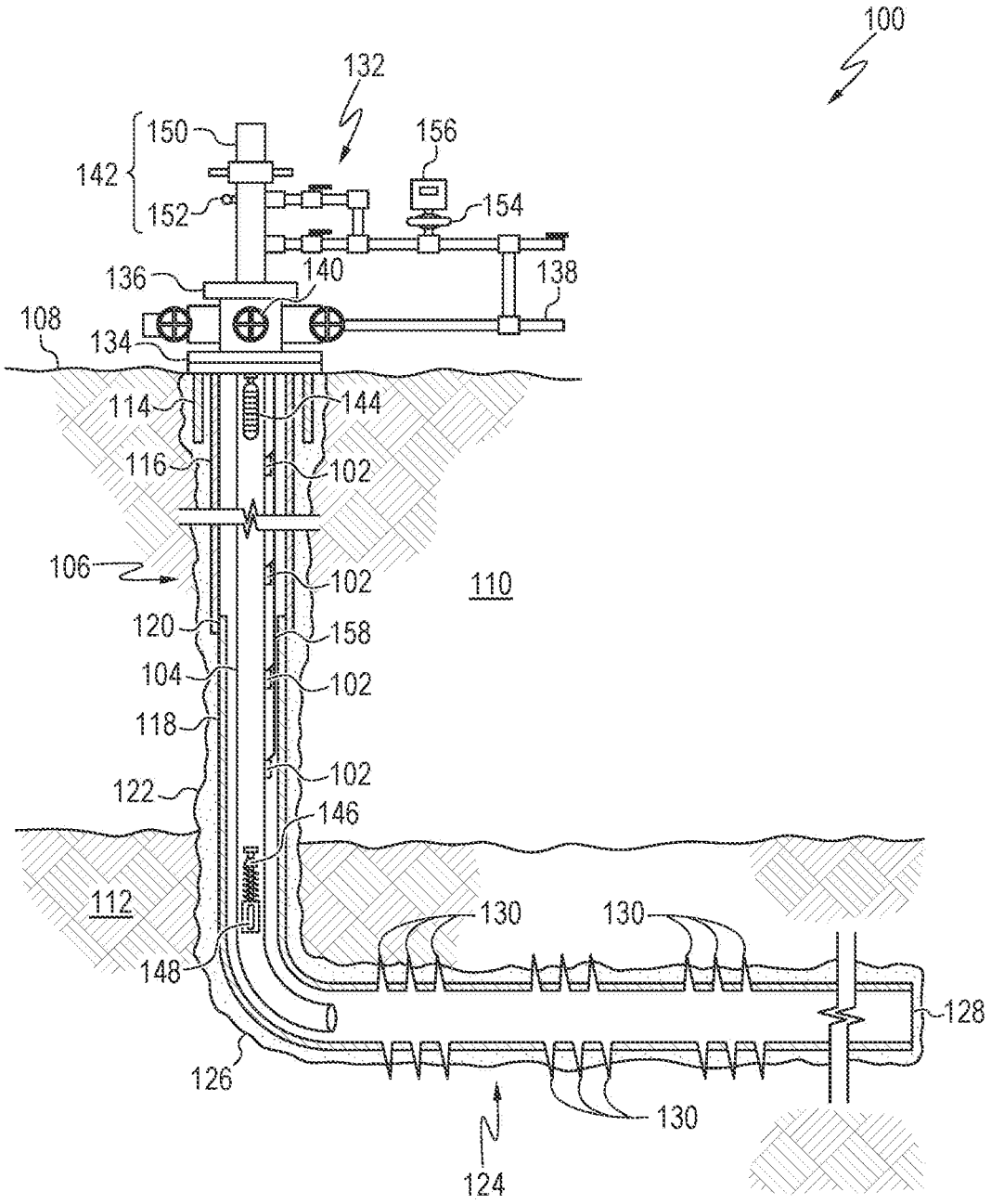
FIG. 1 is a schematic view of an exemplary hydrocarbon well including magnetic sensor systems installed along an outer diameter of the production tubing for a conventional plunger lift operation according to embodiments described herein.

It should be noted that the figures are merely examples of the present techniques and are not intended to impose limitations on the scope of the present techniques. Further, the figures are generally not drawn to scale, but are drafted for purposes of convenience and clarity in illustrating various aspects of the techniques.

DETAILED DESCRIPTION OF THE INVENTION

In the following detailed description section, the specific examples of the present techniques are described in connection with preferred embodiments. However, to the extent that the following description is specific to a particular embodiment or a particular use of the present techniques, this is intended to be for example purposes only and simply provides a description of the embodiments. Accordingly, the techniques are not limited to the specific embodiments described below, but rather, include all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition those skilled in the art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the singular forms "a," "an," and "the" mean one or more when applied to any embodiment described herein. The use of "a," "an," and/or "the" does not limit the meaning to a single feature unless such a limit is specifically stated.

The terms "about" and "around" mean a relative amount of a material or characteristic that is sufficient to provide the intended effect. The exact degree of deviation allowable in some cases may depend on the specific context, e.g., ±1%, ±5%, ±10%, ±15%, etc. It should be understood by those of skill in the art that these terms are intended to allow a description of certain features described and claimed without restricting the scope of these features to the precise numerical ranges provided. Accordingly, these terms should be interpreted as indicating that insubstantial or inconsequential modifications or alterations of the subject matter described are considered to be within the scope of the disclosure.

The term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "including," may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the term "any" means one, some, or all of a specified entity or group of entities, indiscriminately of the quantity.

The phrase "at least one," in reference to a list of one or more entities, should be understood to mean at least one entity selected from any one or more of the entities in the list of entities, but not necessarily including at least one of each and every entity specifically listed within the list of entities, and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently, "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

As used herein, the phrase "based on" does not mean "based only on," unless expressly specified otherwise. In other words, the phrase "based on" means "based only on," "based at least on," and/or "based at least in part on.

As used herein, the term "configured" means that a given element, component, or other subject matter is designed and/or intended to perform a given function. Thus, the use of the term "configured" should not be construed to mean that the given element, component, or other subject matter is simply "capable of" performing a given function, but that the element, component, or other subject matter is specifically selected, created, implemented, utilized, and/or designed for the purpose of performing the function.

As used herein, the terms "example," exemplary," and "embodiment," when used with reference to one or more components, features, structures, or methods according to the present techniques, are intended to convey that the described component, feature, structure, or method is an illustrative, non-exclusive example of components, features, structures, or methods according to the present techniques. Thus, the described component, feature, structure, or method is not intended to be limiting, required, or exclusive/exhaustive; and other components, features, structures, or methods, including structurally and/or functionally similar and/or equivalent components, features, structures, or methods, are also within the scope of the present techniques.

As used herein, the term "fluid" refers to gases and liquids, as well as to combinations of gases and liquids, combinations of gases and solids, combinations of liquids and solids, and combinations of gases, liquids, and solids.

The term "gas" is used interchangeably with "vapor," and is defined as a substance or mixture of substances in the gaseous state as distinguished from the liquid or solid state. Likewise, the term "liquid" means a substance or mixture of substances in the liquid state as distinguished from the gas or solid state.

A "gas lift system" is a type of artificial lift system used to remove completion fluids from a well or increase the performance of the well. The gas lift system generally includes a valve system for controlling the injection of compressed, or pressurized, gas from a source external to the well, such as a compressor, into the borehole. The increased pressure from the injected gas forces accumulated formation fluid up the tubing to remove the fluids as production flow or to clear the fluids and restore the free flow of gas from the formation into the well.

A "gas lift valve" is a valve used in a gas lift system to control the flow of lift gas into the production tubing conduit. Operation of the gas lift valve may be determined by preset opening and closing pressures in the tubing or annulus, depending on the specific application. A reverse-flow check valve may or may not be integral to the gas lift valve.

A "hydrocarbon" is an organic compound that primarily includes the elements hydrogen and carbon, although nitrogen, sulfur, oxygen, metals, or any number of other elements may be present in small amounts. As used herein, the term "hydrocarbon" generally refers to components found in natural gas, oil, or chemical processing facilities. Moreover, the term "hydrocarbon" may refer to components found in raw natural gas, such as $CH_4$, $C_2H_2$, $C_2H_4$, $C_2H_6$, $C_3$ isomers, $C_4$ isomers, benzene, and the like.

A "plunger lift system" is a type of artificial lift system that is typically used to unload relatively small volumes of liquid from gas-dominated wells. A plunger lift system includes an automated control system mounted on the wellhead that controls the well on an intermittent flow regime. When the well is shut-in, a plunger is dropped down the production tubing. Then, when the control system opens the well for production, the plunger and a column of fluid are carried up the production tubing to the surface. A plunger lift system also includes a surface receiving mechanism at the wellhead that detects the plunger when it arrives and, through the control system, prepares for the next cycle.

The term "production tubing" refers to a wellbore tubular used to produce hydrocarbon fluids from a reservoir.

The term "substantially," when used in reference to a quantity or amount of a material, or a specific characteristic thereof, refers to an amount that is sufficient to provide an effect that the material or characteristic was intended to provide. The exact degree of deviation allowable may depend, in some cases, on the specific context.

The term "wellbore" refers to a borehole drilled into a subterranean formation. The borehole may include vertical, deviated, highly deviated, and/or horizontal sections. The term "wellbore" also includes the downhole equipment associated with the borehole, such as the casing strings, production tubing, gas lift valves, and other subsurface equipment. Relatedly, the term "hydrocarbon well" (or simply "well") includes the wellbore in addition to the wellhead and other associated surface equipment.

Certain embodiments and features are described herein using a set of numerical upper limits and a set of numerical lower limits. It should be appreciated that ranges from any lower limit to any upper limit are contemplated unless otherwise indicated. All numerical values are "about" or "approximately" the indicated value, and account for experimental errors and variations that would be expected by those skilled in the art.

Furthermore, concentrations, dimensions, amounts, and/or other numerical data that are presented in a range format are to be interpreted flexibly to include not only the numerical values explicitly recited as the limits of the range, but also all individual numerical values or sub-ranges encompassed within that range, as if each numerical value and sub-range were explicitly recited. For example, a disclosed numerical range of 1 to 200 should be interpreted to include, not only the explicitly-recited limits of 1 and 200, but also individual values, such as 2, 3, 4, 197, 198, 199, etc., as well as sub-ranges, such as 10 to 50, 20 to 100, etc.

As described above, both conventional plunger lift systems and gas-assisted plunger lift (GAPL) systems could benefit from the determination of various parameters relating to plunger operation. However, conventional techniques for determining such plunger parameters are generally inefficient and/or inaccurate. In particular, there is currently not an efficient or accurate means of determining the position of a plunger within a plunger-lifted well. According to conventional techniques, the plunger position can only be estimated through calculations that are based on surface arrival times and the associated fluid flow. Such calculations are performed with assumed (and often incorrect) parameters, leading to inaccurate results and, as a result, inefficient plunger operation. As an example, according to conventional techniques, it is possible to utilize an acoustic device to estimate the plunger position (which is often referred to as "shooting" the plunger). However, this method is prone to noise interference, requires an acoustic transit delay between shots, involves difficult data analysis techniques, and is ineffective when the plunger falls below the liquid level in the wellbore. As another example, fiber optics can be used to estimate the plunger position. However, the high installation cost, burdensome data analysis requirements, and unreliability of this method render it generally undesirable.

In addition, according to conventional techniques, the fall time of the plunger is roughly estimated using industry standards that are in place to protect surface equipment. However, if the plunger fall time is underestimated such that the plunger does not fall all the way to the bottom of the wellbore before the sales valve is reopened, there is an increased likelihood of damage to the lubricator and other wellhead equipment as a result of a potential high-velocity "dry trip," where the plunger surfaces without a leading liquid cushion. Conversely, if the plunger fall time is overestimated such that the plunger spends time needlessly resting at the bottom of the wellbore, the wellbore is prevented from being brought back onto production as quickly as possible, resulting in missed sales opportunities. Therefore, if the plunger position and plunger fall velocity could be efficiently and accurately determined, the potential for equipment damage could be mitigated, and the fluid inflow from the reservoir could be maximized. In addition, determination of the plunger position and plunger fall velocity may enable the well operator to select a plunger type that matches the wellbore conditions and, thus, helps to optimize production.

Moreover, if the plunger position and plunger velocity could be determined at various depths within the wellbore, inferences could be made about certain well properties. As an example, plunger fall velocities measured at several different known wellbore depths could be analyzed and compared to infer the fluid level within the wellbore. The inferred fluid level, coupled with the known plunger lift operation flow timing and fluid properties, could then be used to provide an empirical calculation of reservoir inflow.

Accordingly, embodiments described herein provide systems and methods for accurately and efficiently determining parameters relating to plunger operation, such as, in particular, the plunger position and the plunger velocity. Specifically, according to embodiments described herein, one or more magnetic sensor systems are incorporated along the production tubing and are used to detect voltage changes caused by the metallic plunger as it passes each magnetic sensor system. The plunger position can then be determined based on the location or depth of the corresponding magnetic sensor system. In addition, the plunger velocity can be determined based on the amount of time it takes the plunger to pass by two or more known locations, such as between two or more magnetic sensor systems separated by known distances within the wellbore or between the lubricator and a single magnetic sensor system located a known distance from the lubricator. Furthermore, in various embodiments, the magnetic sensor system(s) are connected to an electrical cable, such as a tubing encapsulated conductor (TEC) line, that runs to the surface, and the measured voltage changes are communicated through the TEC line to the surface to enable the plunger parameters to be calculated.

The techniques described herein can be utilized to determine plunger parameters for conventional plunger lift operations and/or GAPL operations. In particular, for conventional plunger lift operations and poor-boy GAPL operations, the magnetic sensor system(s) may be installed along the outer wall of the production tubing, while for conventional-mandrel GAPL operations, the magnetic sensor system(s) may be installed within (or attached to) the conventional mandrels or the associated gas lift valves, as described further herein. Moreover, in either case, the magnetic sensor system(s) may be tied into a single cable (e.g., a single TEC line), which may already be run downhole to power various pressure gauges. However, those skilled in the art will appreciate that various other configurations, power sources, and communication techniques for the magnetic sensor systems are also possible, depending on the details of the particular implementation. As an example, in some embodiments, the magnetic sensor system(s) are installed within (or attached to) one or more electrically-actuated gas lift assemblies that are used to fully optimize a GAPL operation, as described further herein. As another example, in some embodiments, the magnetic sensor system(s) are powered using an independent power source, such as an onboard battery or a downhole energy harvesting device, and communicate with the surface via one or more transceivers, rather than being connected to a TEC line or other cable.

Those skilled in the art will appreciate that the techniques described herein provide various advantages over conventional techniques for determining plunger parameters during conventional plunger lift and/or GAPL operations. As an example, the techniques described herein utilize magnetic sensors that produce sensor data that are easy to analyze as compared to acoustic data produced by the acoustic sensors used for conventional techniques. As another example, the techniques described herein provide the ability to continuously and accurately monitor plunger position and/or velocity at various locations or depths within the wellbore. As another example, the techniques described herein involve minimal installation costs since the magnetic sensor systems are easily attachable to/detachable from the production tubing and/or can easily be attached to (or integrated within) gas lift assemblies and then installed within the corresponding mandrels. As yet another example, in contrast to conventional techniques utilizing acoustic methods, the sensor data recorded by the magnetic sensor systems described herein are not susceptible to noise interference.

Exemplary Hydrocarbon Wells Including Magnetic Sensor Systems for Determining Plunger Parameters FIG. 1 is a schematic view of an exemplary hydrocarbon well 100 including magnetic sensor systems 102 installed along the outer diameter of the production tubing 104 for a conventional plunger lift operation according to embodiments described herein. The hydrocarbon well 100 includes a wellbore 106 that extends from the surface 108 into a subsurface formation 110 that is composed of several subsurface intervals, including a hydrocarbon-bearing interval (or reservoir) 112. The wellbore 106 has been completed by setting a series of tubulars into the subsurface formation 110. These tubulars include several strings of casing, such as a surface casing string 114, an intermediate casing string 116, and a production casing string 118, which is sometimes referred to as a "production liner." In some embodiments, additional intermediate casing strings (not shown) are also included to provide support for the walls of the wellbore 106. According to the embodiment shown in FIG. 1, the surface casing string 114 and the intermediate casing string 116 are hung from the surface 108, while the production casing string 118 is hung from the bottom of the intermediate casing string 116 using a liner hanger 120.

The surface casing string 114 and the intermediate casing string 116 are set in place using cement 122. The cement 122 isolates the intervals of the subsurface formation 110 from the wellbore 106 and each other. The production casing string 118 may also be set in place using cement 122, as shown in FIG. 1. Alternatively, the wellbore 106 may be set as an open-hole completion, meaning that the production casing string 118 is not set in place using cement.

According to the embodiment shown in FIG. 1, the wellbore 106 is completed with a horizontal (or lateral) section 124. The lateral section 124 has a heel 126 and a toe 128 that extends through the reservoir 112 within the subsurface formation 110. However, those skilled in the art will appreciate that the wellbore 106 may also include any number of additional or alternative vertical, lateral, deviated, and/or highly-deviated sections extending in various directions through the subsurface formation 110, depending on the details of the particular implementation.

As shown in FIG. 1, the lateral section 124 of the production casing string 118 includes a number of perforations 130 that allow hydrocarbon fluids from the reservoir 112 to flow into the wellbore 106 via corresponding fractures (not shown) within the reservoir 112. While only three sets of perforations 130 are shown in FIG. 1, those skilled in the art will appreciate that laterally-completed wellbores typically extend for some length, such as, of example, for a length of one, two, or even more miles, and include multiple stages of perforations. In addition, those skilled in the art will appreciate that the near-wellbore region of the reservoir 112 is fractured through each set of perforations using any of various hydraulic fracturing techniques, such as, for example, plug-and-perforation (or "plug-and-perf") techniques.

The hydrocarbon well 100 also includes a wellhead 132 located at the surface 108. The wellhead 132 includes any suitable arrangement of pipes, valves, and other equipment for controlling the operation of the hydrocarbon well 100. For example, the wellhead 132 includes a casing head 134 and a tubing head 136. In addition, the wellhead 132 includes an attached sales line 138, as well as a master valve 140 that provides a means of shutting in the wellbore 106 when desired. Furthermore, because the hydrocarbon well 100 is a plunger-lifted well, the wellhead 132 includes a specialized lubricator 142 that is configured to control the movement of a metal cylinder (referred to as a "plunger") 144 up and down the production tubing 104 within the wellbore 106. In particular, when the lubricator 142 drops the plunger 144, the plunger 144 gravitationally falls into the production tubing 104 until it lands on a bumper spring 146, which rests on top of a tubing stop or standing valve 148 that permits fluids to flow into the production tubing 104 from below the bumper spring 146.

The lubricator 142 itself is defined by an elongated, sealed cylindrical pipe 150 including an energy-absorbing spring (not shown) and a plunger catch 152. When the plunger 144 is forced up the production tubing 104 to the surface 108 in response to the build-up of reservoir pressure below the plunger 144, the spring absorbs the mechanical impact of the plunger 144, while the plunger catch 152 maintains the plunger 144 within the lubricator 142 to allow hydrocarbon fluids to flow more freely from the wellbore 106. In addition, the wellhead 132 includes a motor valve 154 and a controller 156 that assist in controlling various wellhead functions, including the cycle for dropping the plunger 144. The controller 156 may include, for example, an electronic controller, a dedicated controller, a special-purpose controller, a personal computer, a special-purpose computer, a display device, a logic device, and/or a memory device. Moreover, in various embodiments, the controller 156 and any number of other wellhead components are communicably coupled to one or more local and/or remote computing systems (not shown) that control the operation of the controller 156 and the other wellhead components.

As described herein, it is desirable to determine various parameters relating to the operation of the plunger 144 within the plunger-lifted hydrocarbon well 100. Therefore, according to the embodiment shown in FIG. 1, the hydrocarbon well 100 includes a number of magnetic sensor systems 102 installed along the production tubing 104. Each magnetic sensor system 102 includes one or more magnetic sensors. In various embodiments, such magnetic sensor(s) include one or more Hall sensors that detect the presence and magnitude of a magnetic field using the Hall effect. However, those skilled in the art will appreciate that any other suitable type(s) of magnetic sensors may be additionally or alternatively utilized, such as, for example, one or more coil magnetometers, one or more reed switch magnetic sensors, and/or one or more magnetoresistive magnetic sensors. Each magnetic sensor system 102 may also include any number of other optional components. For example, each magnetic sensor system 102 may include one or more onboard processors, such as a central processing unit (CPU), a microprocessor, a system on chip (SOC), a digital signal processor (DSP), an application specific integrated circuit (ASIC), and/or a field programmable gate array (FPGA). Each magnetic sensor system may include one or more onboard memory components, such as non-volatile flash memory (e.g., NAND flash memory and/or NOR flash memory), random-access memory (RAM) (e.g., static RAM (SRAM), dynamic RAM (DRAM), synchronous DRAM (SDRAM), or the like), and/or read-only memory (ROM) (e.g., programmable ROM (PROM), erasable PROM (EPROM), electronically erasable PROM (EEPROM), or the like). In various embodiments, each magnetic sensor system 102 also includes one or more communication connections for communicably coupling the magnetic sensor system 102 to one or more remote computing systems using any of various different types of wireless and/or wired communications techniques. In addition, in some embodiments, each magnetic sensor system 102 also includes any number of additional sensors, such as, for example, one or more acoustic sensors that can be used to supplement the results obtained using the magnetic sensor(s). Moreover, in various embodiments, the components of the magnetic sensor system 102 are electrically coupled to a circuit board and encased within a water-resistant housing that is suitable for use within a downhole environment.

According to the embodiment shown in FIG. 1, the magnetic sensor systems 102 are tied to a single electrical cable 158 that provides power to the magnetic sensor systems 102 and provides a means of communication between the magnetic sensor systems 102 and the controller 156 and/or one or more other computing systems (not shown) located at the surface 108. In various embodiments, the electrical cable 158 is a tubing encapsulated conductor (TEC) line, although those skilled in the art will appreciate that any other suitable electrical cable may alternatively be utilized. For example, in some embodiments, the electrical cable 158 is a TEC line that is already run into the wellbore 106 to power downhole pressure gauges and/or other downhole equipment. Therefore, in such embodiments, the magnetic sensor systems 102 can be installed within the wellbore 106 without adding any additional cables that will consume the already-limited amount of space within the wellbore 106. Moreover, while the embodiment shown in FIG. 1 includes the single electrical cable 158 that is shared or utilized by all the magnetic sensor systems 102 within the wellbore 102, those skilled in the art will appreciate that separate, distinct, or dedicated electrical cables may alternatively be provided to any or all of the magnetic sensor systems 102. Furthermore, the magnetic sensor systems 102 are not limited to being powered by the electrical cable 158 but, instead, may be powered using any other suitable type of power source, such as, for example, an onboard battery or a downhole energy harvesting device. In such embodiments, each magnetic sensor system 102 may include a communication device in the form of a transceiver, for example, that is configured to enable communication between the magnetic sensor system 102 and the controller 156 and/or other computing system(s) located at the surface 108.

The magnetic sensor systems 102 may be designed to attach to the outer wall of the production tubing 104 in any suitable manner, preferably before the production tubing 104 is run into the wellbore 106. For example, the magnetic sensor systems 102 may be pre-welded to individual tubing joints of the production tubing 104 or glued to the tubing joints using an adhesive, such as epoxy. However, it is generally preferable for the magnetic sensor systems 102 to be configured to selectively attach to/detach from the tubing joints by mechanical means. Accordingly, in various embodiments, the magnetic sensor systems 102 are attached to the tubing joints using clamps, straps, bolts, or any other suitable type of fastener.

In various embodiments, the magnetic sensor systems 102 are separated by some predetermined distance within the wellbore 102, where such predetermined distance may vary depending on the details of the particular implementation. As an example, assuming that each tubing joint is around 30 feet long, one magnetic sensor system 102 may be installed for every 20 to 30 tubing joints; or, in other words, the magnetic sensor systems 102 may be installed around 600 feet to around 900 feet apart along the production tubing 104. As another example, assuming that each tubing joint is around 30 feet long, one magnetic sensor system 102 may be installed for every 10 to 40 tubing joints; or, in other words, the magnetic sensor systems 102 may be installed around 300 feet to around 1,200 feet apart along the production tubing 104. In addition, in some embodiments, each installation location includes more than one magnetic sensor system 102 to increase the confidence or redundancy of the resulting sensor readings. For example, in such embodiments, two magnetic sensor systems 102 may be installed on a single tubing joint and circumferentially separated by around 45 degrees to around 180 degrees around the outer wall of the tubing joint.

In operation, the utilization of the magnetic sensor systems 102 within the plunger-lifted hydrocarbon well 100 enables the determination of various plunger parameters, such as, in particular, the plunger's position and/or velocity, through the detection of the voltage change that occurs as the plunger 144 passes each magnetic sensor system 102 on its way up or down the production tubing 104. More specifically, according to embodiments described herein, the magnetic sensor(s) (e.g., Hall sensor(s)) within each magnetic sensor system 102 transmit an electrical sensor signal through the electrical cable 158 (or other communication means) to the surface 108 when tripped by the passage of the metallic plunger 144. At the surface 108, the controller 156 and/or other computing system(s) may then analyze the timing of the electrical sensor signal and the location (or depth) of the corresponding magnetic sensor system 102 to determine the plunger's position. In addition, the controller 156 and/or other computing system(s) may determine the plunger's velocity by analyzing the difference in timing between electrical sensor signals received from two or more magnetic sensor systems 102 located known distances from each other within the wellbore 106.

In some embodiments, the magnetic sensor systems 102 are polled sequentially to reduce the power and communication burdens on the overall plunger lift system. However, in other embodiments, multiple magnetic sensor systems 102 are simultaneously polled to enable the real-time determination of plunger parameters within the production tubing 104. In various embodiments, this simultaneous polling is enabled, at least in part, by configuring each magnetic sensor system 102 with a unique electrical fingerprint or key that ensures that the magnetic sensor system 102 is an individualized wellbore component. In this manner, the controller 156 and/or other computing system(s) receiving the resulting electrical sensor signals are able to determine the exact magnetic sensor system 102 corresponding to each received signal and, thus, the corresponding location/depth at which each signal was obtained.

Figure 2:
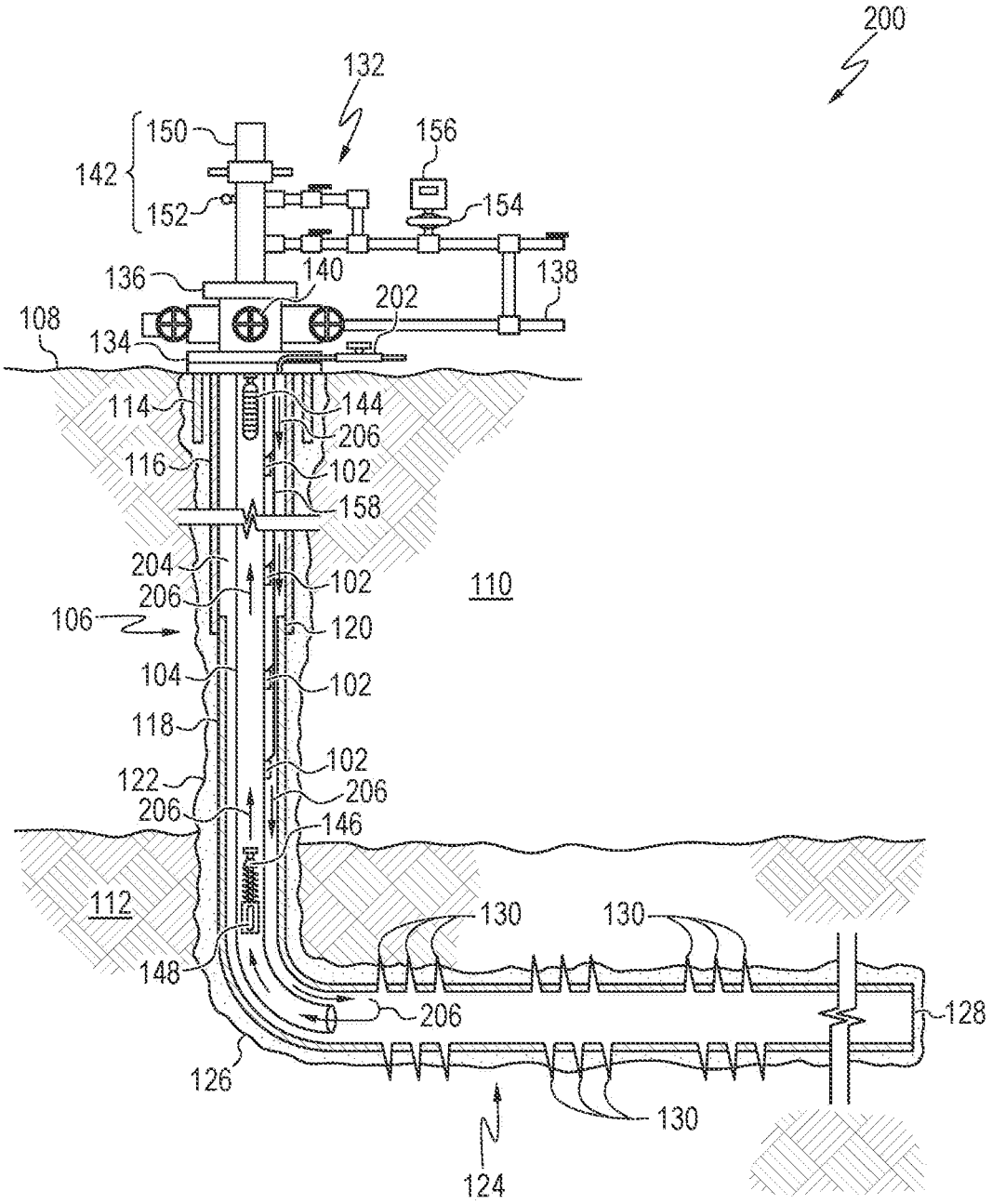
FIG. 2 is a schematic view of another exemplary hydrocarbon well including the magnetic sensor systems installed along the outer diameter of the production tubing for a "poor-boy" gas-assisted plunger lift (GAPL) operation according to embodiments described herein.

FIG. 2 is a schematic view of another exemplary hydrocarbon well 200 including the magnetic sensor systems 102 installed along the outer diameter of the production tubing 104 for a "poor-boy" GAPL operation according to embodiments described herein. Like numbered items are as described with respect to FIG. 1. In various embodiments, the "poor-boy" GAPL configuration shown in FIG. 2 may be used to quickly and inexpensively transform a plunger-lifted well into a gas-assisted plunger-lifted well. More specifically, the hydrocarbon well 200 of FIG. 2 may be similar to the hydrocarbon well 100 of FIG. 1. However, within the hydrocarbon well 200 of FIG. 2, the wellhead 132 may be modified to add an injection line 202 for injecting lift gases into an annulus 204 of the wellbore 106 (e.g., the area between the outer wall of the production tubing 104 and the inner wall of the casing strings 114, 116, and 118) during a GAPL operation. In various embodiments, such lift gases are composed, at least in part, of light hydrocarbon gases that are separated from the produced hydrocarbon fluids and then injected back into the annulus 204.

As indicated by arrows 206 in FIG. 2, the injected lift gas travels down the annulus 204 and around the end of the production tubing 104. From there, the lift gas travels through the tubing stop or standing valve 148 below the bumper spring 146 and up the production tubing 104, thereby reducing the hydrostatic head and, in combination with the build-up of reservoir pressure below the bumper spring 146, forcing the plunger 144 back to the lubricator 142 at the surface 108.

In various embodiments, because such a "poor-boy" GAPL design is notably inefficient, utilizing the magnetic sensor systems 102 described herein to monitor various plunger parameters may be particularly advantageous. In particular, the dynamic determination of the plunger position and velocity may enable the wellbore operator to determine the overall effectiveness of the GAPL operation and to make any suitable alterations, such as, for example, selecting a plunger type that matches the current wellbore conditions and/or changing the timing for dropping the plunger 144 into the wellbore 106.

Figure 3:
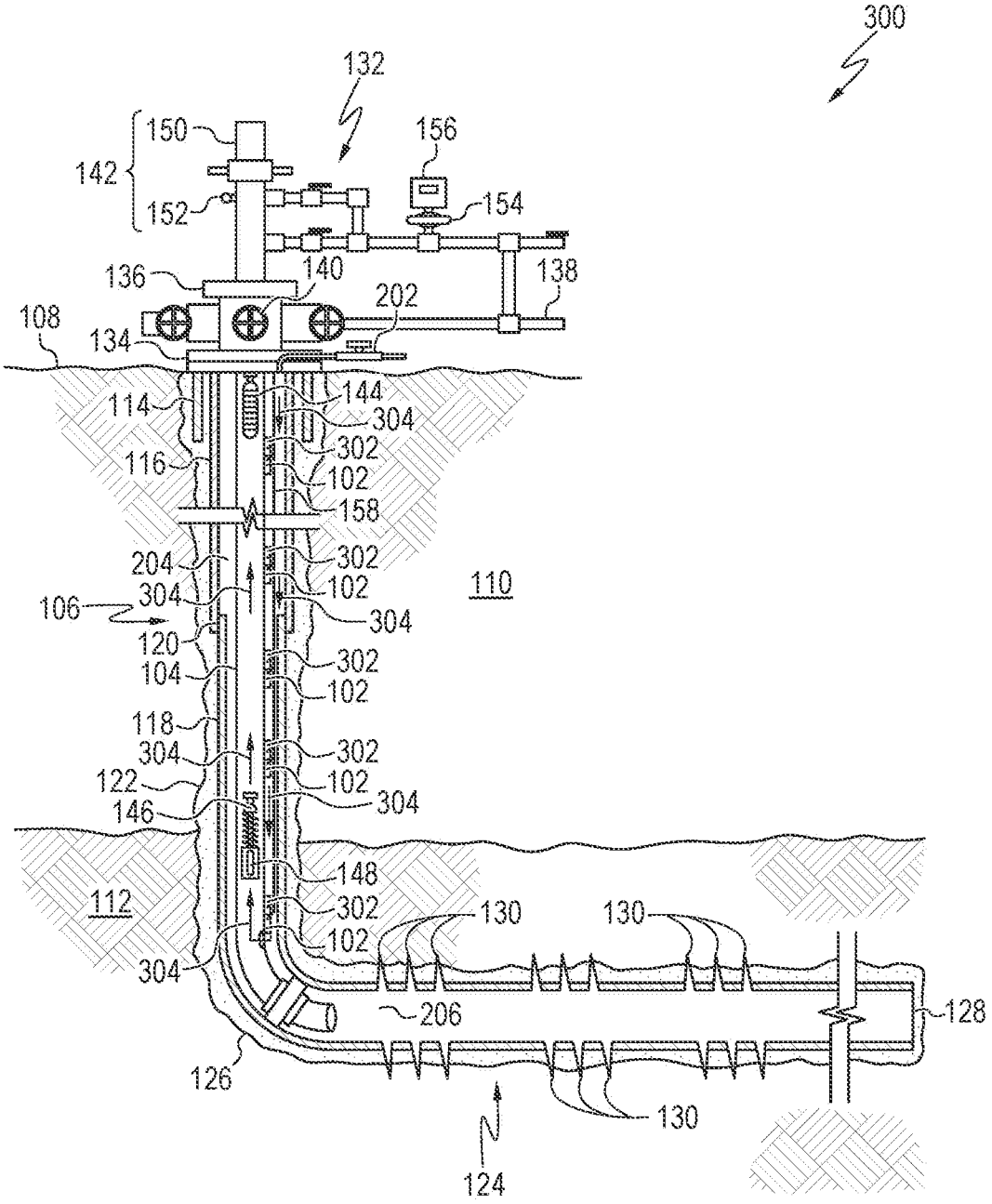
FIG. 3 is a schematic view of another exemplary hydrocarbon well including the magnetic sensor systems installed on conventional mandrels for a conventional-mandrel GAPL operation according to embodiments described herein.

FIG. 3 is a schematic view of another exemplary hydrocarbon well 300 including the magnetic sensor systems 102 installed on conventional mandrels 302 for a conventional-mandrel GAPL operation according to embodiments described herein. Like numbered items are as described with respect to FIGS. 1 and 2. For the conventional-mandrel GAPL configuration shown in FIG. 3, the lift gas injected via the injection line 202 travels down the annulus 204 and enters the interior of the production tubing 104 via the operating gas lift valve, which is typically the gas lift valve positioned within the lowest (or most downhole-located) conventional mandrel 302 in the wellbore 106, as indicated by arrows 304. In various embodiments, the conventional mandrel 302 including the operating gas lift valve is located below the bumper spring 146. Therefore, as the lift gas enters the production tubing 104 and begins to flow toward the surface 108, it serves to reduce the hydrostatic head in the wellbore 106 and, in combination with the build-up of reservoir pressure below the bumper spring 146, forces the plunger 144 back to the lubricator 142 at the surface 108.

According to the embodiment shown in FIG. 3, the magnetic sensor systems 102 are operatively coupled to the gas lift valves within the conventional mandrels 302. In particular, in some embodiments, the magnetic sensor system 102 is installed between the gas lift valve and the reverse-flow check valve within the conventional mandrel 302, or between the check valve and the lug of the conventional mandrel 302, as described further with respect to FIG. 4. Moreover, those skilled in the art will appreciate that the magnetic sensor systems 102 may alternatively be attached to the conventional mandrels 302 in any other suitable manner.

Moreover, in various embodiments, the gas lift valves within the conventional mandrels 302 are electrically-actuated gas lift valves. In such embodiments, the electrical cable 158 (e.g., TEC line) that is used to provide power and communication capabilities to the magnetic sensor systems 102 may be the same as the electrical cable that is used to provide power and communication capabilities to the electrically-actuated gas lift valves. In addition, in such embodiments, the magnetic sensor systems 102 may optionally be integrated into the electrically-actuated gas lift valve assemblies to further streamline and optimize the GAPL operation.

Furthermore, in some embodiments, the gas lift valves within the conventional mandrels 302 are power-generating gas lift valves including power generation devices, such as, for example, rotary assemblies in combination with electrical generators. In such embodiments, the magnetic sensor systems 102 may be powered using the power generated by such gas lift valves, and magnetic sensor systems 102 may also include transceivers for enabling communication between the magnetic sensor system 102 and the controller 156 and/or other computing system(s) located at the surface 108.

The schematic views of FIGS. 1, 2, and 3 are not intended to indicate that the hydrocarbon wells 100, 200, and 300, respectively, are to include all of the components shown in the figures. Moreover, any number of additional components may be included within the hydrocarbon wells 100, 200, and/or 300, depending on the details of the specific implementation. Furthermore, the schematic views of FIGS. 1, 2, and 3 are not intended to indicate that the hydrocarbon wells 100, 200, and 300, respectively, or the magnetic sensor systems 102 are limited to the configurations shown in the figures. Rather, the hydrocarbon wells 100, 200, and/or 300 and/or the magnetic sensor systems 102 can include any number of suitable alternative configurations that can be envisioned by those skilled in the art.

Figure 4:
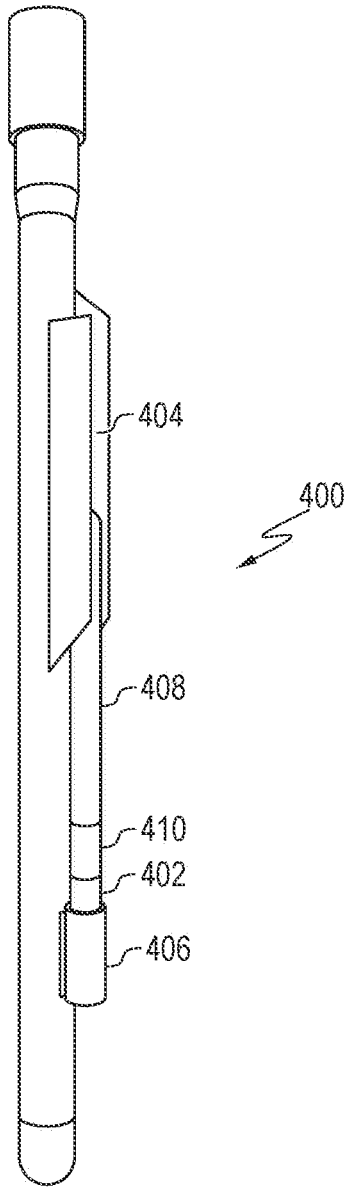
FIG. 4 is a schematic view of an exemplary conventional mandrel including an installed magnetic sensor system according to embodiments described herein.

Exemplary Installation of Magnetic Sensor System Described Herein Within Conventional Mandrel FIG. 4 is a schematic view of an exemplary conventional mandrel 400 including an installed magnetic sensor system 402 according to embodiments described herein. As shown in FIG. 4, the conventional mandrel 400 is a specialized tubing joint including (among other components) an exterior valve guard 404 and an exterior-ported lug 406 for securing a gas lift valve 408 and a corresponding reverse-flow check valve 410 within the conventional mandrel 400. According to conventional techniques, the reverse-flow check valve 410 typically screws directly into the lug 406. However, according to the embodiment shown in FIG. 4, the magnetic sensor system 402 is installed between the reverse-flow check valve 410 and the lug 406. In other words, one end of the magnetic sensor system 402 may be attached to the reverse-flow check valve 410, while the other end may be screwed into the lug 406. Therefore, in such embodiments, the magnetic sensor system 402 may include a customized housing that is specifically designed to attach to the reverse-flow check valve 410 and the lug 406 in the desired manner. Alternatively, in some embodiments, the magnetic sensor system 402 may entirely replace the reverse-flow check valve 410, in which case the magnetic sensor system 402 may also include components that enable the magnetic sensor system 402 to perform the function typically provided by the reverse-flow check valve 410 in addition to the sensing functions described herein.

The schematic view of FIG. 4 is not intended to indicate that the conventional mandrel 400 is to include all of the components shown in FIG. 4. Moreover, any number of additional components may be included within the conventional mandrel 400, depending on the details of the specific implementation. In addition, the schematic view of FIG. 4 is not intended to indicate that the magnetic sensor system 402 is always installed in the location shown in FIG. 4. Rather, those skilled in the art will appreciate that the magnetic sensor system 402 can be attached to the conventional mandrel 400 and/or any associated equipment in any suitable manner. For example, in some embodiments, rather than being installed within the conventional mandrel 400 and attached to the reverse-flow check valve 410, the magnetic sensor system 402 may be externally attached to the conventional mandrel 400, such as, for example, externally attached to the inner-diameter side of the lug 406 of the conventional mandrel 400 (or in any other thin-walled location along the conventional mandrel 400).

Furthermore, those skilled in the art will appreciate that the magnetic sensor system described herein can alternatively be installed within (or attached to) a side-pocket mandrel rather than the conventional mandrel 400 of FIG. 4. In particular, the magnetic sensor system can be installed within a specialized side-pocket mandrel including a movable curtain or other similar component that enables the passage of a plunger when used for GAPL operations.

Figure 5:
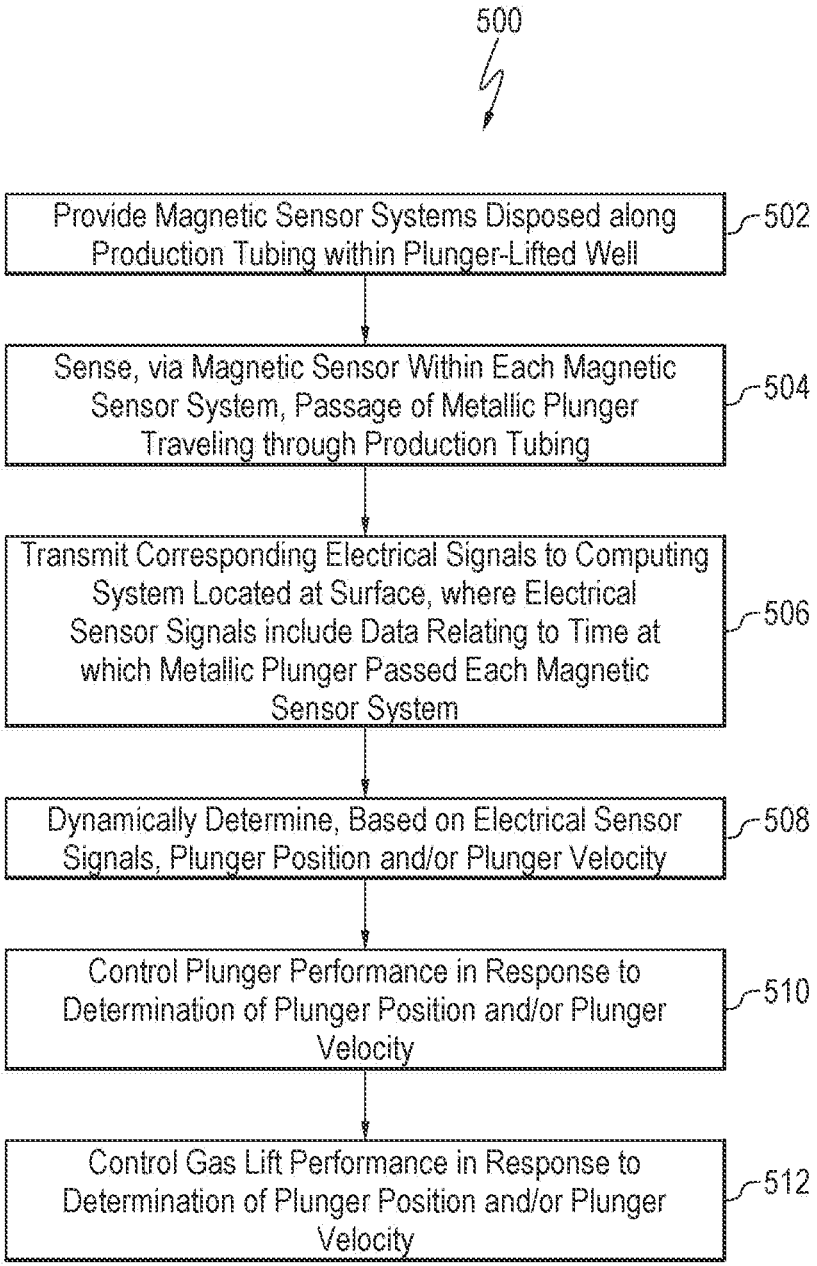
FIG. 5 is a process flow diagram of an exemplary method for monitoring plunger parameters within a wellbore corresponding to a plunger-lifted well.

Exemplary Method for Determining Plunger Parameters According to Techniques Described Herein FIG. 5 is a process flow diagram of an exemplary method 500 for monitoring plunger parameters within a wellbore corresponding to a plunger-lifted well. The method 500 is implemented by the plunger lift system described herein. The plunger lift system includes a lubricator attached to the wellhead at the surface, a plunger dimensioned to travel through the production tubing upon being released from the lubricator, and a bumper spring residing in the production tubing and configured to receive the plunger when it travels toward the bottom of the wellbore. The plunger lift system also includes magnetic sensor systems installed along the production tubing, where each magnetic sensor system includes one or more magnetic sensors for detecting the passage of the metallic plunger as it travels through the production tubing, as well as a communication device that is configured to transmit communication signals between each magnetic sensor system and one or more computing systems located at the surface. The plunger lift system further includes the computing system(s), where each computing system include a processor and one or more non-transitory, computer-readable storage media including computer-executable instructions that direct the processor to perform some portion of the techniques describe herein, as described further with respect to FIGS. 6 and 7.

Turning now to the details of the method 500, the method 500 begins at optional block 502, at which magnetic sensor systems are provided disposed along the production tubing within the plunger-lifted well, as described herein. In some embodiments, each magnetic sensor system is fastened to the outer wall of a tubing joint of the production tubing such that the magnetic sensor system is selectively attachable to and detachable from the tubing joint. In such embodiments, each installation location for the magnetic sensor systems may be separated by around 10 to around 40 tubing joints or, more preferably, by around 20 to 30 tubing joints. In addition, in such embodiments, each installation location (or some portion thereof) may optionally include two or more magnetic sensor systems installed on a single tubing joint and circumferentially separated by around 45 degrees to around 180 degrees around the outer wall of the tubing joint.

In some embodiments, the plunger lift system is a gas-assisted plunger lift system, and the plunger lift system also includes an injection line for injecting lift gas down the annulus of the wellbore and back up the production tubing to the surface to assist with the return of the plunger to the lubricator at the surface. In such embodiments, the plunger lift system may optionally include mandrels disposed along the production tubing, where each mandrel is configured to secure a gas lift valve within the mandrel. Moreover, in such embodiments, the lift gas enters the production tubing via at least one of the gas lift valves, and each magnetic sensor system is secured to one of the mandrels. In some such embodiments, the gas lift valves are electrically-actuated gas lift valves, and the communication device includes an electrical cable that is electrically coupled to the gas lift valves and the magnetic sensor systems and is configured to provide power to the gas lift valves and the corresponding magnetic sensor systems and to transmit communication signals between each gas lift valve and the computing system(s), as well as between each magnetic sensor system and the computing system(s). In some such embodiments, the gas lift valves are power-generating gas lift valves; each magnetic sensor system is powered using power generated by a corresponding power-generating gas lift valve; and the communication device includes a transceiver integrated within each magnetic sensor system that is configured to transmit communication signals between the magnetic sensor system and the computing system(s) located at the surface. In some such embodiments, the mandrels are conventional mandrels; each conventional mandrel includes a valve guard and a lug for securing the gas lift valve and a corresponding reverse-flow check valve within the conventional mandrel; and each magnetic sensor system is designed to be installed between the lug and the reverse-flow check valve. In some such embodiments, the mandrels are conventional mandrels; each conventional mandrel includes a valve guard and a lug for securing the gas lift valve within the conventional mandrel; and each magnetic sensor system is configured to replace a reserve-flow check valve that is typically installed between the lug and the gas lift valve. In some such embodiments, the mandrels are conventional mandrels, and the magnetic sensor systems are externally attached to the conventional mandrels. In some such embodiments, the mandrels are specialized side-pocket mandrels that are configured to operate in conjunction with the plunger, and the magnetic sensor systems are installed within the specialized side-pocket mandrels.

At block 504, one or more magnetic sensors within each magnetic sensor system are used to sense the passage of the metallic plunger as it travels through the production tubing. As described herein, in various embodiments, the magnetic sensor are Hall sensors that utilize the Hall effect to detect the presence and magnitude of the magnetic field created by the traveling plunger. However, other suitable type(s) of magnetic sensors may be additionally or alternatively utilized, depending on the details of the particular implementation.

At block 506, the resulting electrical sensor signals are transmitted to the computing system(s) located at the surface, where the electrical sensor signals include data relating to the time at which the plunger passed each magnetic sensor system within the wellbore. For example, in various embodiments, the communication device within the plunger lift system is a single electrical cable (e.g., a TEC line) that is electrically coupled to the magnetic sensor systems, and the electrical sensor signals are transmitted from the magnetic sensor systems to the computing system(s) via the electrical cable. However, in other embodiments, the communication device is a transceiver located within each magnetic sensor system, and the electrical sensor signals are wirelessly transmitted from the magnetic sensor systems to the computing system(s) via the transceivers.

In various embodiments, each magnetic sensor system includes a unique electrical fingerprint or key. In such embodiments, multiple magnetic sensor systems may simultaneously transmit communication signals to the computing system(s), and the computing system(s) then analyze each communication signal based on the unique electrical fingerprints or keys to determine the particular magnetic sensor system from which each communication signal originated.

At optional block 508, the plunger position and/or plunger velocity are dynamically determined via the computing system based on the received electrical sensor signals. In response to the determination of the plunger position and/or plunger velocity, the plunger performance may then be dynamically controlled at optional block 510 and, for embodiments in which the well is a gas-assisted plunger-lifted wells, the gas lift performance may be dynamically controlled at optional block 512. For example, in some embodiments, controlling the plunger performance and/or the gas lift performance includes dynamically determining adjustments to the operation of various well equipment (e.g., wellhead equipment relating to the operation of the plunger lift (or GAPL) system) in response to the determination of the plunger position and/or the plunger velocity. Such adjustments may include, for example, adjustments to the motor valve operation and/or the gas injection rate. Moreover, in such embodiments, the plunger lift system also includes a controller that is communicably coupled to the computing system(s) (or integrated within one of the computing systems) and is configured to adjust the operation of the well equipment in response to instructions received from (or generated by) the computing system(s).

The process flow diagram of FIG. 5 is not intended to indicate that the steps of the method 500 are to be executed in any particular order, or that all of the steps of the method 500 are to be included in every case. Further, any number of additional steps not shown in FIG. 5 may be included within the method 500, depending on the details of the specific implementation.

Exemplary Cluster Computing System for Implementing Techniques Described Herein

Figure 6:
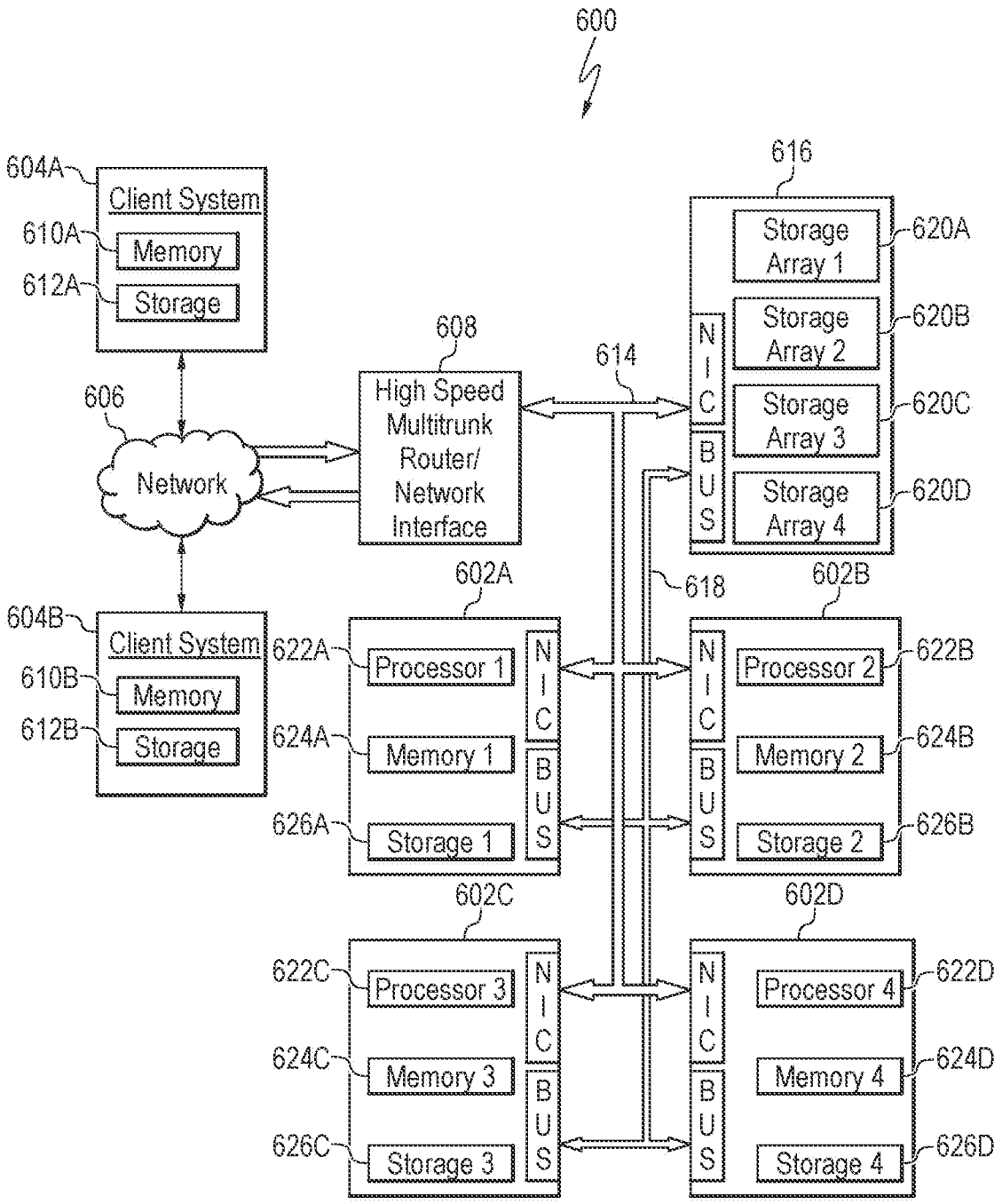
FIG. 6 is a block diagram of an exemplary cluster computing system that may be utilized to implement a portion of the plunger monitoring techniques described herein.

FIG. 6 is a block diagram of an exemplary cluster computing system 600 that may be utilized to implement a portion of the plunger monitoring techniques described herein. The exemplary cluster computing system 600 shown in FIG. 6 has four computing units 602A, 602B, 602C, and 602D, each of which may perform calculations for a portion of the plunger monitoring techniques described herein. However, one of ordinary skill in the art will recognize that the cluster computing system 600 is not limited to this configuration, as any number of computing configurations may be selected. For example, a smaller analysis may be run on a single computing unit, such as a workstation, while a large calculation may be run on a cluster computing system 600 having tens, hundreds, thousands, or even more computing units.

The cluster computing system 600 may be accessed from any number of client systems 604A and 604B over a network 606, for example, through a high-speed network interface 608. The computing units 602A to 602D may also function as client systems, providing both local computing support and access to the wider cluster computing system 600.

The network 606 may include a local area network (LAN), a wide area network (WAN), the Internet, or any combinations thereof. Each client system 604A and 604B may include one or more non-transitory, computer-readable storage media for storing the computer-executable instructions that are used to implement the plunger monitoring techniques described herein. For example, each client system 604A and 604B may include a memory device 610A and 610B, which may include random access memory (RAM), read only memory (ROM), and the like. Each client system 604A and 604B may also include a storage device 612A and 612B, which may include any number of hard drives, optical drives, flash drives, or the like.

The high-speed network interface 608 may be coupled to one or more buses in the cluster computing system 600, such as a communications bus 614. The communication bus 614 may be used to communicate instructions and data from the high-speed network interface 608 to a cluster storage system 616 and to each of the computing units 602A to 602D in the cluster computing system 600. The communications bus 614 may also be used for communications among the computing units 602A to 602D and the cluster storage system 616. In addition to the communications bus 614, a high-speed bus 618 can be present to increase the communications rate between the computing units 602A to 602D and/or the cluster storage system 616.

The cluster storage system 616 can have one or more non-transitory, computer-readable storage media, such as storage arrays 620A, 620B, 620C and 620D for the storage of models, data, visual representations, results (such as graphs, charts, and the like used to convey results obtained using the plunger monitoring techniques described herein), code, and other information concerning the implementation of the plunger monitoring techniques described herein. The storage arrays 620A to 620D may include any combinations of hard drives, optical drives, flash drives, or the like.

Each computing unit 602A to 602D can have a processor 622A, 622B, 622C and 622D and associated local non-transitory, computer-readable storage media, such as a memory device 624A, 624B, 624C and 624D and a storage device 626A, 626B, 626C and 626D. Each processor 622A to 622D may be a multiple core unit, such as a multiple core central processing unit (CPU) or a graphics processing unit (GPU). Each memory device 624A to 624D may include ROM and/or RAM used to store program instructions for directing the corresponding processor 622A to 622D to implement the techniques described herein. Each storage device 626A to 626D may include one or more hard drives, optical drives, flash drives, or the like. In addition, each storage device 626A to 626D may be used to provide storage for models, intermediate results, data, images, or code associated with operations, including code used to implement at least a portion of the plunger monitoring techniques described herein.

The present techniques are not limited to the architecture or unit configuration illustrated in FIG. 6. For example, any suitable processor-based device may be utilized for implementing at least a portion of the plunger monitoring techniques described herein, including (without limitation) personal computers, laptop computers, computer workstations, mobile devices, and multi-processor servers or workstations with (or without) shared memory. Moreover, at least a portion of the plunger monitoring techniques described herein may be implemented on application specific integrated circuits (ASICs) or very-large-scale integrated (VLSI) circuits. In fact, those skilled in the art may utilize any number of suitable structures capable of executing logical operations according to embodiments described herein.

Figure 7:
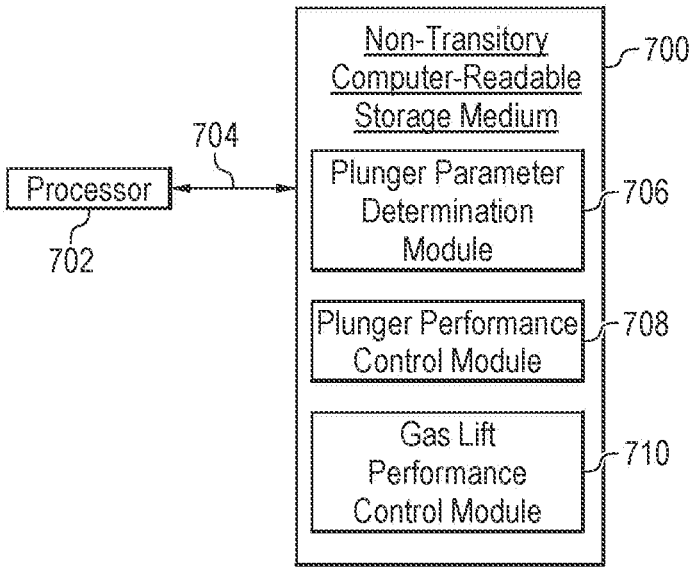
FIG. 7 is a block diagram of an exemplary non-transitory, computer-readable storage medium that may be used for the storage of data and modules of computer-executable instructions for implementing a portion of the plunger monitoring techniques described herein.

FIG. 7 is a block diagram of an exemplary non-transitory, computer-readable storage medium (or media) 700 that may be used for the storage of data and modules of program instructions for implementing a portion of the plunger monitoring techniques described herein. The non-transitory, computer-readable storage medium 700 may include a memory device, a hard disk, and/or any number of other devices, as described with respect to FIG. 6. A processor 702 may access the non-transitory, computer-readable storage medium 700 over a bus or network 704. While the non-transitory, computer-readable storage medium 700 may include any number of modules for implementing the techniques described herein, in some embodiments, the non-transitory, computer-readable storage medium 700 includes a plunger parameter determination module 706 for determining plunger parameters, such as plunger position and/or plunger velocity, using the magnetic sensor systems described herein, a plunger performance control module 708 for optimizing the operation of the plunger lift system based on the determined plunger parameters, and (for embodiments in which the plunger lift system is a gas-assisted plunger lift system) a gas lift performance control module 710 for optimizing the operation of the gas lift portion of the GAPL system based on the determined plunger parameters.

Exemplary Embodiments of Present Techniques

In one or more embodiments, the present techniques may be susceptible to various modifications and alternative forms, such as the following embodiments as noted in paragraphs 1 to 20.

1. A plunger lift system for monitoring plunger parameters within a wellbore, the wellbore comprising a production tubing for conveying fluids from a reservoir to a surface, the plunger lift system comprising: a lubricator attached to a wellhead at the surface; a plunger dimensioned to travel through the production tubing upon being released from the lubricator; a bumper spring residing in the production tubing and configured to receive the plunger when the plunger travels toward the bottom of the wellbore; magnetic sensor systems installed along the production tubing, wherein each magnetic sensor system comprises a magnetic sensor for detecting a passage of the plunger as the plunger travels through the production tubing; a communication device that is configured to transmit communication signals between each magnetic sensor system and a computing system located at the surface; and the computing system, comprising: a processor; and a non-transitory, computer-readable storage medium comprising computer-executable instructions that direct the processor to dynamically determine at least one of a plunger position or a plunger velocity based on the communication signals received from the magnetic sensor systems.
2. The plunger lift system of paragraph 1, wherein the non-transitory, computer-readable storage medium of the computing system further comprises computer-executable instructions that direct the processor of the computing system to dynamically determine at least one adjustment to the operation of well equipment in response to the determination of the at least one of the plunger position or the plunger velocity; and wherein the plunger lift system further comprises a controller that is communicably coupled to the computing system and the well equipment and is configured to adjust the operation of the well equipment in response to instructions received from the computing system.
3. The plunger lift system of paragraph 1 or 2, wherein each magnetic sensor system is fastened to an outer wall of a tubing joint of the production tubing such that the magnetic sensor system is selectively attachable to and detachable from the tubing joint.
4. The plunger lift system of paragraph 3, wherein each installation location for the magnetic sensor systems is separated by 10 to 40 tubing joints.
5. The plunger lift system of paragraph 3 or 4, wherein each installation location for the magnetic sensor systems comprises two or more magnetic sensor systems installed on a single tubing joint and circumferentially separated by around 45 degrees to around 180 degrees around the outer wall of the tubing joint.
6. The plunger lift system of any of paragraphs 1 to 5, wherein the plunger lift system comprises a gas-assisted plunger lift system, and wherein the plunger lift system further comprises an injection line for injecting lift gas down an annulus of the wellbore and back up the production tubing to the surface to assist with the return of the plunger to the lubricator at the surface.
7. The plunger lift system of paragraph 6, further comprising mandrels disposed along the production tubing, wherein each mandrel is configured to secure a gas lift valve within the mandrel, wherein the lift gas enters the production tubing via at least one of the gas lift valves, and wherein each magnetic sensor system is secured to one of the mandrels.
8. The plunger lift system of paragraph 7, wherein the gas lift valves are electrically-actuated gas lift valves, and wherein the communication device comprises an electrical cable that is electrically coupled to the gas lift valves and the magnetic sensor systems and is configured to provide power to the gas lift valves and the corresponding magnetic sensor systems and to transmit communication signals between each gas lift valve and the computing system, as well as between each magnetic sensor system and the computing system.

9. The plunger lift system of paragraph 7, wherein the gas lift valves are power-generating gas lift valves, wherein each magnetic sensor system is powered using power generated by a corresponding power-generating gas lift valve, and wherein the communication device comprises a transceiver integrated within each magnetic sensor system that is configured to transmit communication signals between the magnetic sensor system and the computing system located at the surface.

10. The plunger lift system of any of paragraphs 7 to 9, wherein the mandrels are conventional mandrels, and wherein each conventional mandrel comprises a valve guard and a lug for securing the gas lift valve and a corresponding reverse-flow check valve within the conventional mandrel, and where each magnetic sensor system is designed to be installed between the lug and the reverse-flow check valve.

11. The plunger lift system of any of paragraphs 7 to 9, wherein the mandrels are conventional mandrels, and wherein each conventional mandrel comprises a valve guard and a lug for securing the gas lift valve within the conventional mandrel, and where each magnetic sensor system is configured to replace a reserve-flow check valve that is typically installed between the lug and the gas lift valve.

12. The plunger lift system of any of paragraphs 7 to 9, wherein the mandrels are conventional mandrels, and wherein the magnetic sensor systems are externally attached to the conventional mandrels.

13. The plunger lift system of any of paragraphs 7 to 9, wherein the mandrels are specialized side-pocket mandrels that are configured to operate in conjunction with the plunger, and wherein the magnetic sensor systems are installed within the specialized side-pocket mandrels.

14. The plunger lift system of any of paragraphs 1 to 13, wherein each magnetic sensor system comprises a unique electrical fingerprint or key.

15. The plunger lift system of paragraph 14, wherein multiple magnetic sensor systems simultaneously transmit communication signals to the computing system, and wherein a particular magnetic sensor system from which each communication signal originates is readily determinable by analyzing each communication signal based on the unique electrical fingerprints or keys corresponding to the magnetic sensor systems.

16. The plunger lift system of any of paragraphs 1 to 15, wherein the communication device is a single electrical cable that is electrically coupled to the magnetic sensor systems.

17. The plunger lift system of any of paragraphs 1 to 16, wherein the magnetic sensors comprise Hall sensors.

18. A method for monitoring plunger parameters within a wellbore corresponding to a plunger-lifted well, wherein the wellbore comprises a production tubing with magnetic sensor systems disposed along the production tubing, and wherein the method comprises: sensing, via a magnetic sensor within each magnetic sensor system, a passage of a metallic plunger traveling through the production tubing; and transmitting resulting electrical sensor signals to a computing system located at the surface, wherein the electrical sensor signals comprise data relating to a time at which the metallic plunger passed each magnetic sensor system.

19. The method of paragraph 18, further comprising: dynamically determining, based on the electrical sensor signals, at least one of a plunger position or a plunger velocity within the wellbore; and controlling plunger performance in response to the determination of the at least one of the plunger position or the plunger velocity.

20. The method of paragraph 18 or 19, wherein the wellbore comprises a gas-assisted plunger-lifted (GAPL) well, and wherein the method further comprises controlling gas lift performance in response to the determination of the at least one of the plunger position or the plunger velocity.

While the embodiments described herein are well-calculated to achieve the advantages set forth, it will be appreciated that such embodiments are susceptible to modification, variation, and change without departing from the spirit thereof. In other words, the particular embodiments described herein are illustrative only, as the teachings of the present techniques may be modified and practiced in different but equivalent manners apparent to those skilled in the art having the benefit of the teachings herein. Furthermore, no limitations are intended on the details of formulation, construction, or design herein shown, other than as described in the claims below. Moreover, the systems and methods illustratively disclosed herein may suitably be practiced in the absence of any element that is not specifically disclosed herein and/or any optional element disclosed herein. While compositions and methods are described in terms of "comprising" or "including" various components or steps, the compositions and methods can also "consist essentially of" or "consist of" the various components and steps. Indeed, the present techniques include all alternatives, modifications, and equivalents falling within the true spirit and scope of the appended claims.

What is claimed is:

1. A plunger lift system for a wellbore, the wellbore comprising a production tubing for conveying fluids from a reservoir to a surface, the plunger lift system comprising:

a lubricator attached to a wellhead at the surface;

a plunger dimensioned to travel through the production tubing upon being released from the lubricator;

a bumper spring residing in the production tubing and configured to receive the plunger when the plunger travels toward the bottom of the wellbore;

a plurality of mandrels disposed along the production tubing, each of the plurality of mandrels having a securing structure that secures a corresponding gas lift valve and a corresponding reverse-flow check valve within each of the mandrels;

magnetic sensor systems installed along the production tubing, wherein each magnetic sensor system comprises a magnetic sensor for detecting a passage of the plunger as the plunger travels through the production tubing, wherein the magnetic sensor systems (i) are designed to be installed between each of the securing structures and corresponding reverse-flow check valves, or (ii) are configured to replace the corresponding reserve-flow check valve between the securing structure and the corresponding gas lift valve;

a communication device that is configured to transmit communication signals between each magnetic sensor system and a computing system located at the surface; and the computing system, comprising:

a processor; and a non-transitory, computer-readable storage medium comprising computer-executable instructions that direct the processor to dynamically determine at least one of a plunger position or a plunger velocity based on the communication signals received from the magnetic sensor systems.

2. The plunger lift system of claim 1, wherein the non-transitory, computer-readable storage medium of the computing system further comprises computer-executable instructions that direct the processor of the computing system to dynamically determine at least one adjustment to the operation of well equipment in response to the determination of the at least one of the plunger position or the plunger velocity; and wherein the plunger lift system further comprises a controller that is communicably coupled to the computing system and the well equipment and is configured to adjust the operation of the well equipment in response to instructions received from the computing system.

3. The plunger lift system of claim 1, wherein each magnetic sensor system is fastened to an outer wall of a tubing joint of the production tubing such that the magnetic sensor system is selectively attachable to and detachable from the tubing joint.

4. The plunger lift system of claim 3, wherein each installation location for the magnetic sensor systems is separated by 10 to 40 tubing joints.

5. The plunger lift system of claim 3, wherein each installation location for the magnetic sensor systems comprises two or more magnetic sensor systems installed on a single tubing joint and circumferentially separated by 45 degrees to 180 degrees around an outer wall of the tubing joint.

6. The plunger lift system of claim 1, wherein the plunger lift system comprises a gas-assisted plunger lift system, and wherein the gas-assisted plunger lift system further comprises an injection line for injecting lift gas down an annulus of the wellbore and back up the production tubing to the surface to assist with the return of the plunger to the lubricator at the surface.

7. The plunger lift system of claim 6, wherein each mandrel is configured to secure the gas lift valve within the mandrel, wherein the lift gas enters the production tubing via at least one of the gas lift valves, and wherein each magnetic sensor system is secured to one of the mandrels.

8. The plunger lift system of claim 7, wherein the gas lift valves are electrically-actuated gas lift valves, and wherein the communication device comprises an electrical cable that is electrically coupled to the gas lift valves and the magnetic sensor systems and is configured to provide power to the gas lift valves and the corresponding magnetic sensor systems and to transmit communication signals between each gas lift valve and the computing system, as well as between each magnetic sensor system and the computing system.

9. The plunger lift system of claim 7, wherein the gas lift valves are power-generating gas lift valves, wherein each magnetic sensor system is powered using power generated by a corresponding power-generating gas lift valve, and wherein the communication device comprises a transceiver integrated within each magnetic sensor system that is configured to transmit communication signals between the magnetic sensor system and the computing system located at the surface.

10. The plunger lift system of claim 7, wherein the mandrels comprise a valve guard for securing the gas lift valve and the corresponding reverse-flow check valve within the mandrel.

11. The plunger lift system of claim 7, wherein the mandrels comprise a valve guard for securing the gas lift valve within the mandrel.

12. The plunger lift system of claim 7, wherein the magnetic sensor systems are externally attached to the mandrels.

13. The plunger lift system of claim 7, wherein the mandrels are side-pocket mandrels that are configured to operate in conjunction with the plunger, and wherein the magnetic sensor systems are installed within the side-pocket mandrels.

14. The plunger lift system of claim 1, wherein each magnetic sensor system comprises a unique electrical fingerprint or key.

15. The plunger lift system of claim 14, wherein multiple magnetic sensor systems simultaneously transmit communication signals to the computing system, and wherein a particular magnetic sensor system from which each communication signal originates is readily determinable by analyzing each communication signal based on the unique electrical fingerprints or keys corresponding to the magnetic sensor systems.

16. The plunger lift system of claim 1, wherein the communication device is a single electrical cable that is electrically coupled to the magnetic sensor systems.

17. The plunger lift system of claim 1, wherein the magnetic sensors comprise Hall sensors.

18. A method for monitoring plunger parameters within a wellbore corresponding to a plunger-lifted well, wherein the wellbore comprises a production tubing with magnetic sensor systems disposed along the production tubing, and wherein the method comprises:

sensing, via a magnetic sensor within each magnetic sensor system, a passage of a metallic plunger traveling through the production tubing, a plurality of mandrels being disposed along the production tubing, each of the plurality of mandrels having a securing structure that secures a corresponding gas lift valve and a corresponding reverse-flow check valve within each of the mandrels, and wherein the magnetic sensor systems (i) are designed to be installed between each of the securing structures and corresponding reverse-flow check valves, or (ii) are configured to replace the corresponding reserve-flow check valve between the securing structure and the corresponding gas lift valve; and transmitting resulting electrical sensor signals to a computing system located at the surface, wherein the electrical sensor signals comprise data relating to a time at which the metallic plunger passed each magnetic sensor system.

19. The method of claim 18, further comprising:

dynamically determining, based on the electrical sensor signals, at least one of a plunger position or a plunger velocity within the wellbore; and controlling plunger performance in response to the determination of the at least one of the plunger position or the plunger velocity.

20. The method of claim 18, wherein the wellbore comprises a gas-assisted plunger-lifted (GAPL) well, and wherein the method further comprises controlling gas lift performance in response to the determination of the at least one of the plunger position or the plunger velocity.

* * * * *